US007159738B2

(12) United States Patent
Luongo

(10) Patent No.: US 7,159,738 B2
(45) Date of Patent: Jan. 9, 2007

(54) MULTI-CELL TANK FOR PRESSURISED GAS

(75) Inventor: Nicolantonio Luongo, Falconara Marittima (IT)

(73) Assignee: Sida Engineering -S.R.L., Ancona (IT)

( * ) Notice: Subject to any disclaimer, the term of this patent is extended or adjusted under 35 U.S.C. 154(b) by 536 days.

(21) Appl. No.: 10/487,325

(22) PCT Filed: Aug. 7, 2002

(86) PCT No.: PCT/IT02/00526

§ 371 (c)(1),
(2), (4) Date: Feb. 17, 2004

(87) PCT Pub. No.: WO03/016777

PCT Pub. Date: Feb. 27, 2003

(65) Prior Publication Data

US 2004/0211784 A1 Oct. 28, 2004

(30) Foreign Application Priority Data

Aug. 20, 2001 (IT) ..... MC2001A0086

(51) Int. Cl.
*F17C 1/00* (2006.01)

(52) U.S. Cl. ..... 220/586

(58) Field of Classification Search ..... None
See application file for complete search history.

(56) References Cited

U.S. PATENT DOCUMENTS 3,537,416 A * 11/1970 Cowles ..... 114/74 A
3,830,180 A * 8/1974 Bolton ..... 114/74 A
4,187,092 A * 2/1980 Woolley ..... 62/46.2
6,095,367 A * 8/2000 Blair et al. ..... 220/581
6,206,027 B1 * 3/2001 Ponnet et al. ..... 137/266

* cited by examiner

*Primary Examiner*—Stephen Castellano
(74) *Attorney, Agent, or Firm*—Armstrong, Kratz, Quintos, Hanson & Brooks, LLP

(57) ABSTRACT

The present invention relates to a multi-cell tank (2) for pressurized gas formed by a group of tubes (2*a*) immersed in a fibrous resin body (4) and reinforced by means of external texture (7), closed with two covers that feature a intercommunicating series of domes on the internal side, which exactly match the opening of the tubes of the group.

1 Claim, 4 Drawing Sheets

MULTI-CELL TANK FOR PRESSURISED GAS

The present patent application for industrial invention relates to a multi-cell tank for pressurised gas with modular structure that allows it to be realised with variable volume and capacity according to the use and installation place of the tank.

Although the main use for this tank is in natural gas vehicles, it is understood that the tank can be used to store any type of high-pressure technical gas.

The tank of the invention is an alternative solution to traditional steel cylinders, with several advantages, such as higher operating safety, easier internal inspection during re-testing, lower weight, higher flexibility in terms of shapes and volumes at the same capacity.

The characteristics of the tank of the invention result from its basic constructive configuration, according to which the total capacity of the tank is given by multiple cylindrical cells in parallel intercommunicating position, realised with a group of thin tubes, to which mechanical resistance is given through an external reinforcement coating of composite resins.

More precisely, the tank of the invention comprises a group of tubes supported by spacing plates with a parallel close series of holes suitable for housing similar tubes that are placed in such a way that each tube is almost in contact with the adjacent tubes in order to reduce dimensions.

The group of tubes is immersed in fibrous resin that fills all the spaces in the group of tubes, flush with the borders of the spacing plates.

The two ends of the group of tubes are sealed with two closing covers that feature an intercommunicating series of hemispherical domes on the internal side, which exactly match the opening of the tubes in the group.

The two covers are joined to the group of tubes by means of tie rods passing through the spaces in the group of tubes.

The group of tubes immersed in fibrous resin is reinforced by wrapping it in a resin-bonded texture with continuous wire, on which a second texture with resin-bonded longitudinal wires is laid in order to join the two covers.

Finally, the tank of the invention is housed in a suitable pre-formed protection enclosure, preferably with aluminium sheet.

Based on this general description of the structural configuration of the tank, the advantages of the tank of the invention become evident with respect to traditional steel cylinders.

First of all, the tank of the invention can be given different shapes by selecting the appropriate number of tubes for each perimeter side.

The length of the tank can be changed by simply varying the length of the tubes in the group.

Moreover, the tank of the invention is characterised by a high capacity/weight ratio, thanks to the low specific weight of the materials used, that is thin metal tubes and fibrous resins, characterised by low specific weight and high mechanical resistance to tensile stress.

As regards the low thickness of the metal tubes, it must be noted that the tubes are not required to have good mechanical resistance, in view of the external fibrous resin coating which is reinforced with transversal and longitudinal texture.

In other words, the tubes only have a modelling function for the series of cylindrical cavities to be obtained in the fibrous resin body of the tank.

The higher operating safety of the tank of the invention derives from the fact that the resistant surface containing pressurised gas has been increased with respect to cylinders with the same capacity, thus reducing the mechanical stress suffered by the surfaces.

As regards the easier internal inspection of the tank, it must be noted that the group of tubes can be internally inspected and cleaned at any time, after removing the two covers. Once inspection and maintenance operations are completed, the two covers are positioned and the tank can be tested.

Currently, for internal inspection purposes, the internal cavity of cylinders is visually inspected through the hole where the gas delivery valve is inserted, after disassembling it. This means that the inspection is carried out through a small hole with ¾ inch diameter, which is not sufficient to ensure total reliability of the control operation aimed to check the integrity of the internal walls of the cylinder.

For major clarity the description of the tank according to the present invention continues with reference to the enclosed drawings, which are intended for purposes of illustration and not in a limiting sense, whereby:

Figure 3:
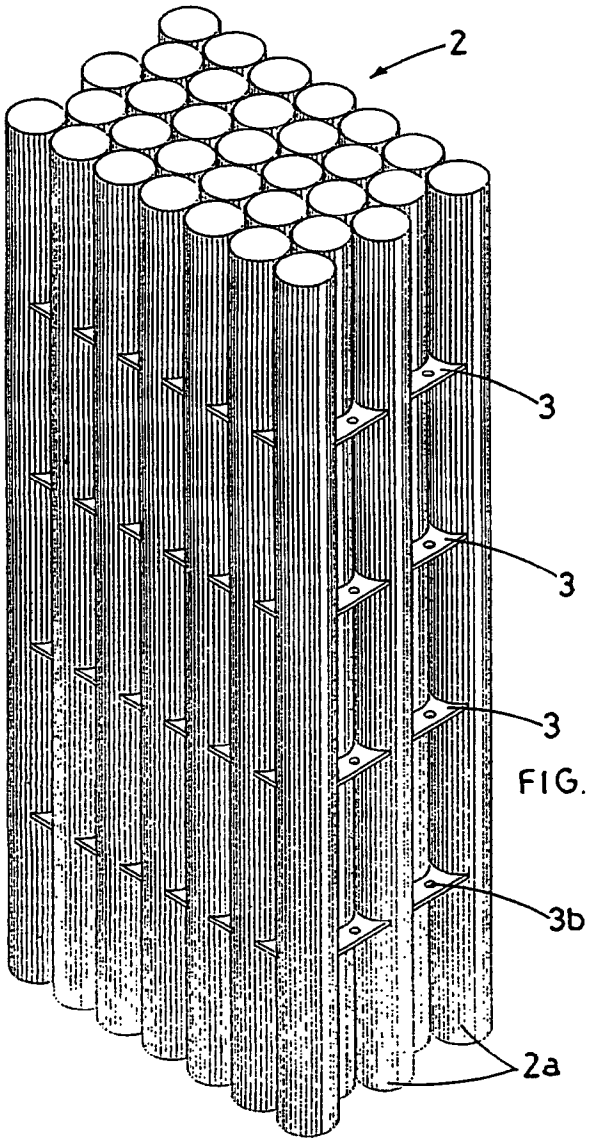
FIG. 3 is a view of the group of tubes supported by spacing plates.

With reference to the enclosed figures, the tank (1) of the invention comprises a group of thin tubes (2) supported by spacing plates (3) with a parallel close series of holes (3*a*) suitable for housing similar tubes (2*a*) that are placed in such a way that each tube (2*a*) is almost in contact with the adjacent tubes in order to reduce dimensions, as shown in FIG. 3.

Figure 4:
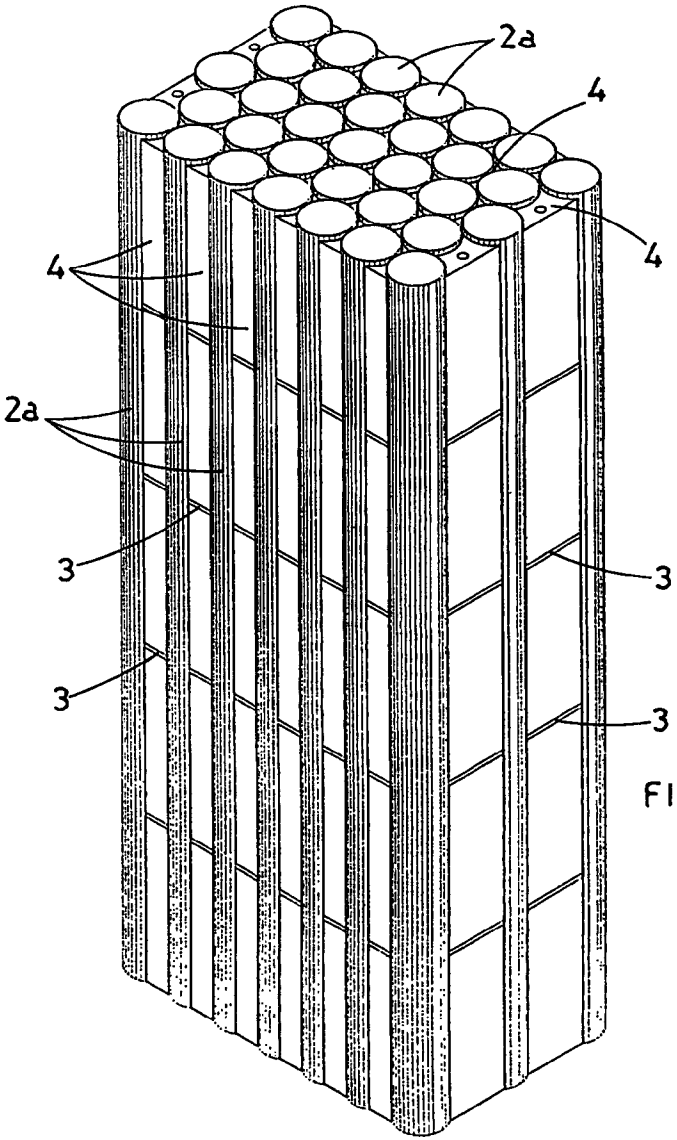
FIG. 4 is a view of the group of tubes immersed in fibrous resin.

The group of tubes (2) is immersed in fibrous resin (4) that fills all the spaces in the group of tubes, including perimeter spaces, where the resin is perfectly flush with the borders of the spacing plates (3), as shown in FIG. 4.

Figure 7A:
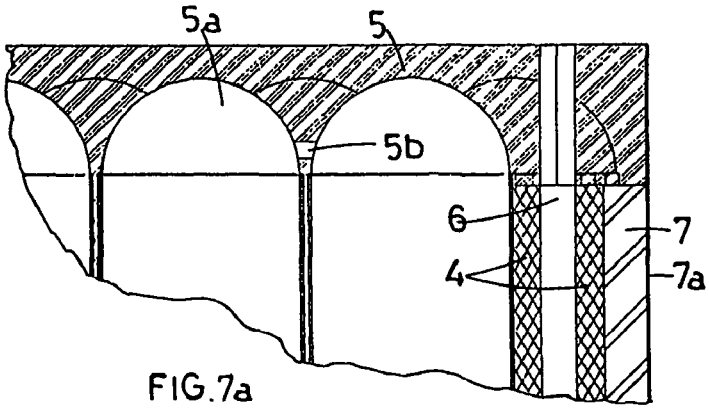
FIGS. 7 and 8 are cross-sections of FIG. 6 with planes VII—VII and VIII—VIII.
Figure 8:
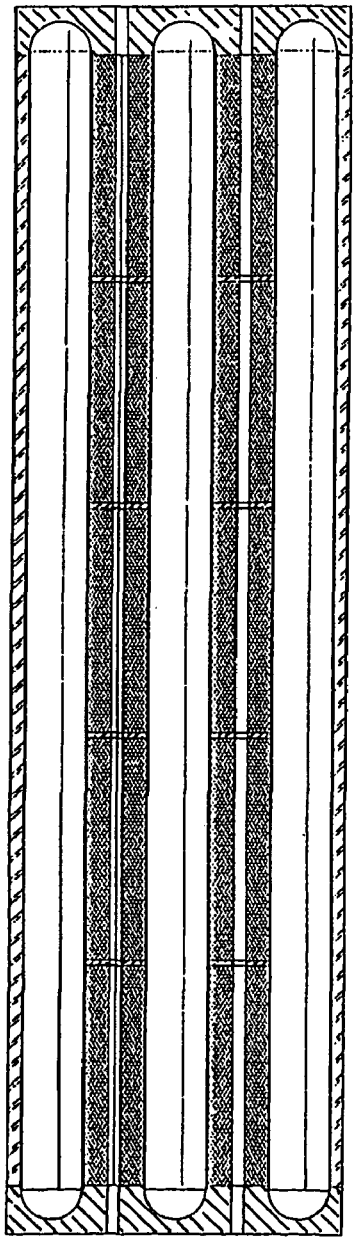
Figure 7:
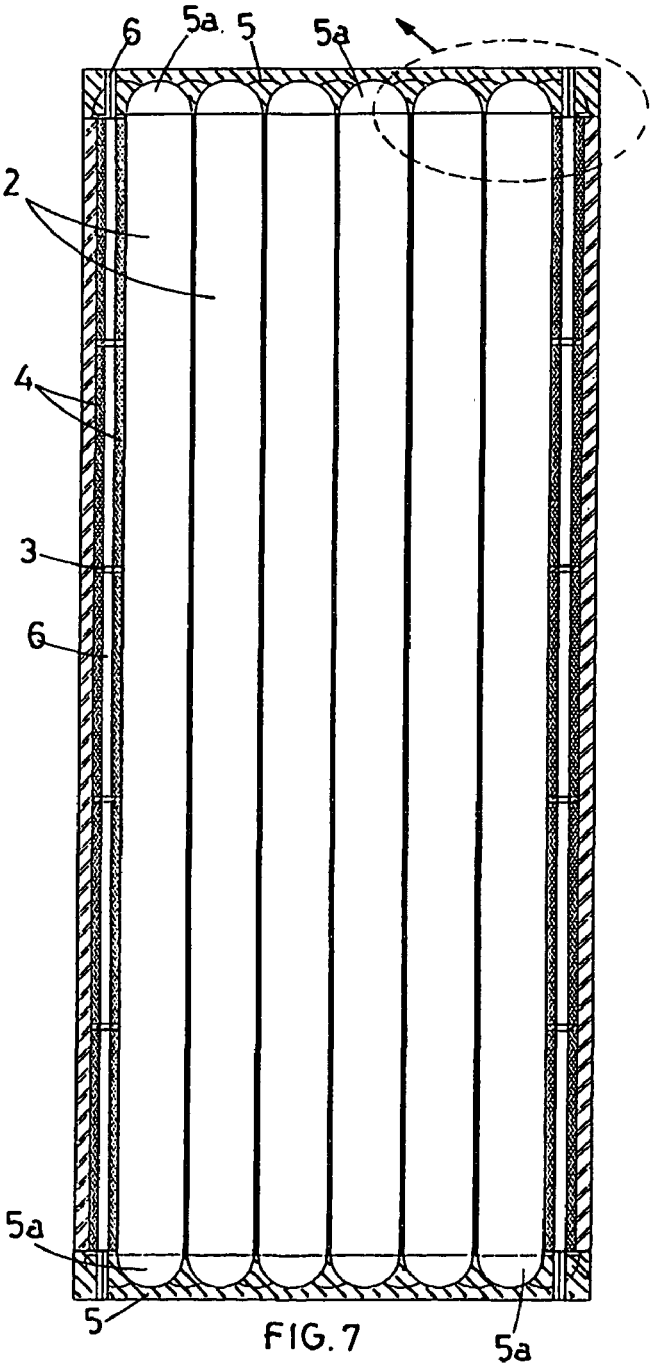

The two ends of the group of tubes (2) are sealed with two closing covers (5) that feature a series of hemispherical domes (5*a*) on the internal side, which communicate through ducts (5*b*) and exactly match the opening of the tubes (2*a*) in the group, as shown in the enlarged view of FIG. 7A.

The two covers (5) are joined to the group of tubes (2) by means of tie rods (6) passing through the spaces in the group of tubes and through holes (3*b*) suitably provided on the spacing plates (3).

Figure 5:
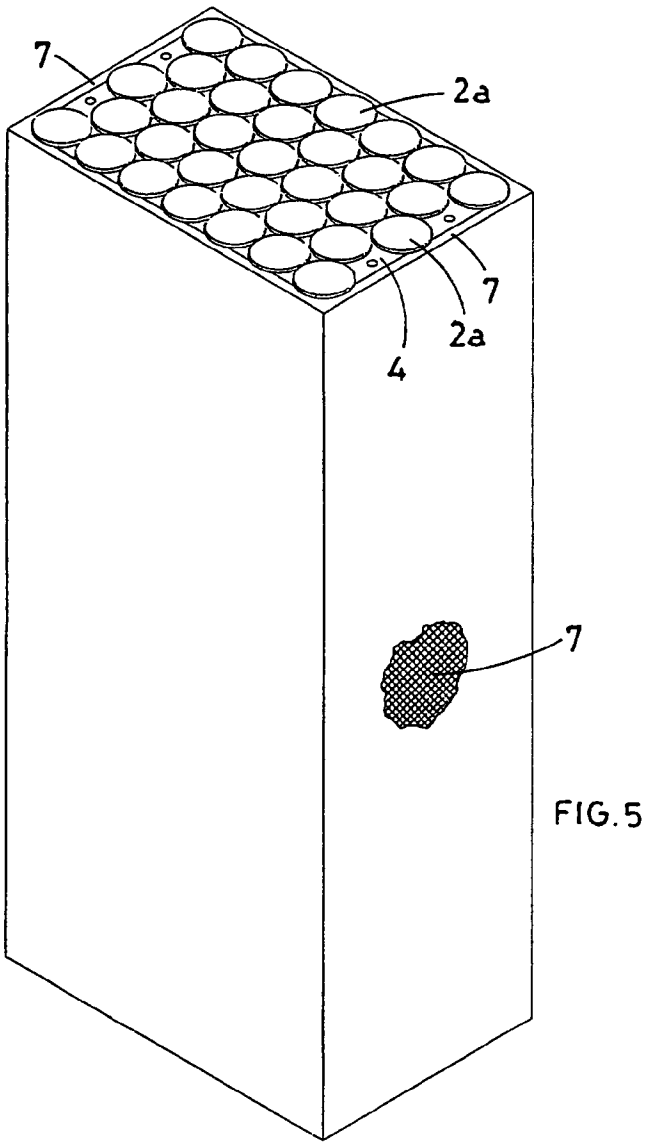
FIG. 5 is a view of the group of tubes immersed in fibrous resin and reinforced with external texture.

The group of tubes immersed in fibrous resin (4) is reinforced by wrapping it in a resin-bonded texture with continues wire (7), as shown in FIG. 5.

Figure 6:
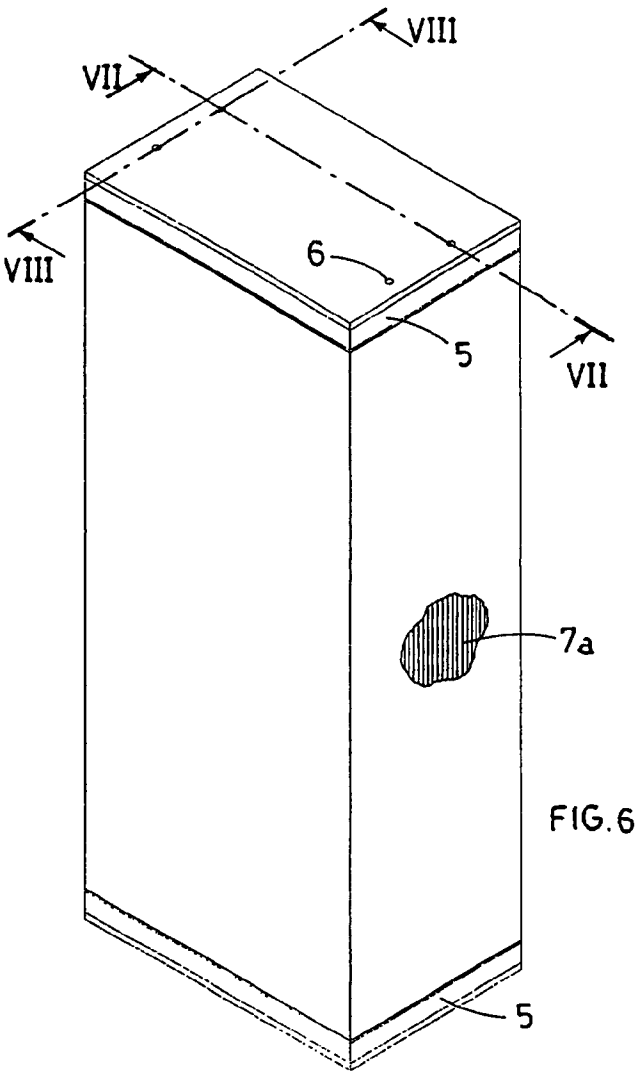
FIG. 6 is a view of the tank provided with covers, not yet inserted in the protection enclosure, as shown in FIG. 1.

A second texture (7*a*) with longitudinal direction only is laid over the first texture (7) in order to join the bottom covers applied and tightened with tie rods (6) to the group of tubes (2), as shown in FIG. 6.

Figure 1:
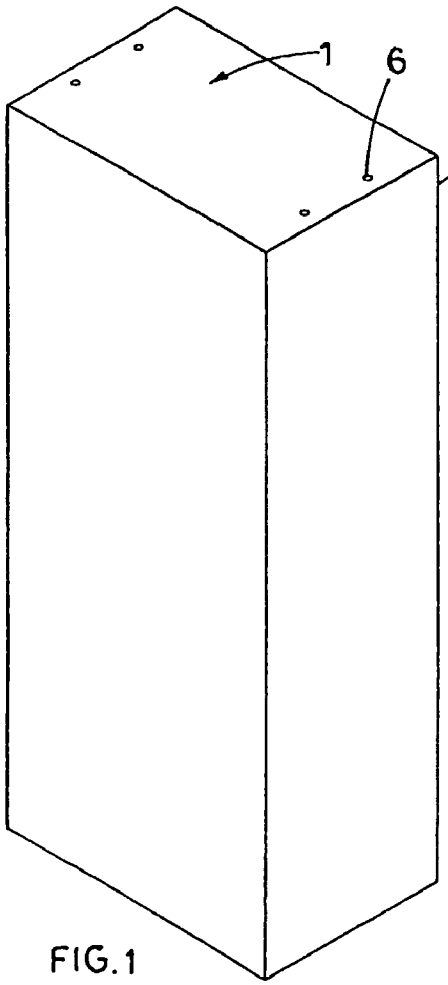
FIG. 1 is a view of the tank with right parallelepiped shape and rectangular base.

The tank of the invention is housed in a suitable pre-formed protection enclosure (8), preferably with aluminium sheet, as shown in FIG. 1.

One of the bottom covers (5) is provided with a hole for the gas valve, of conventional type and for this reason not shown on the enclosed drawings.

It must be said that the gas valve can be placed in the most convenient position in the cover (5), since all hemispherical domes (5) intercommunicate through ducts (5*b*) and therefore the gas contained in the tubes (2*a*) can reach the valve through the net of intercommunicating domes (5*a*).

Figure 9:
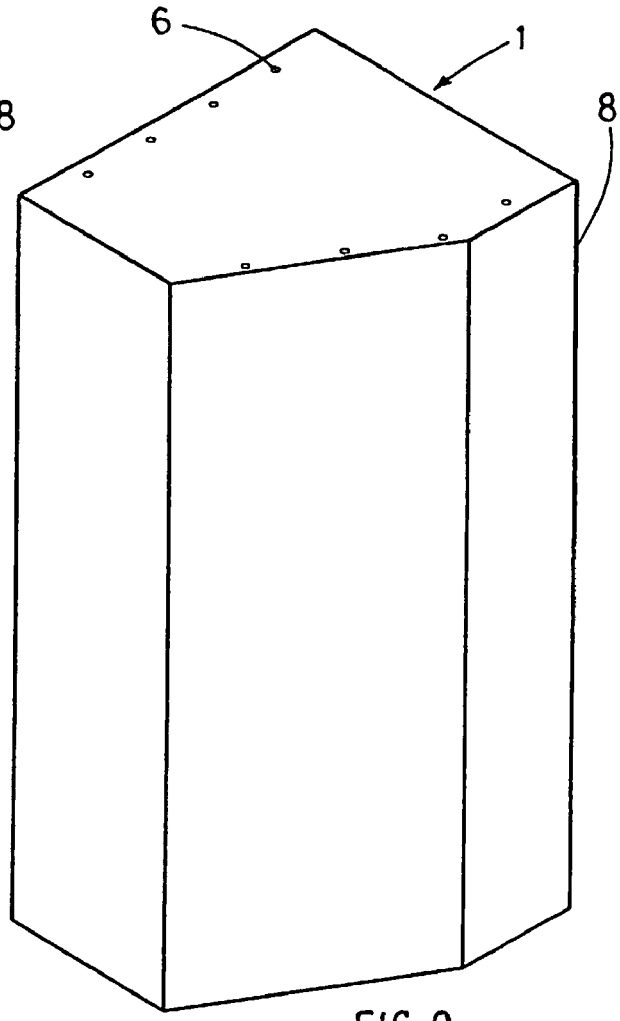
FIG. 9 is a view of the tank with a different shape.
Figure 2:
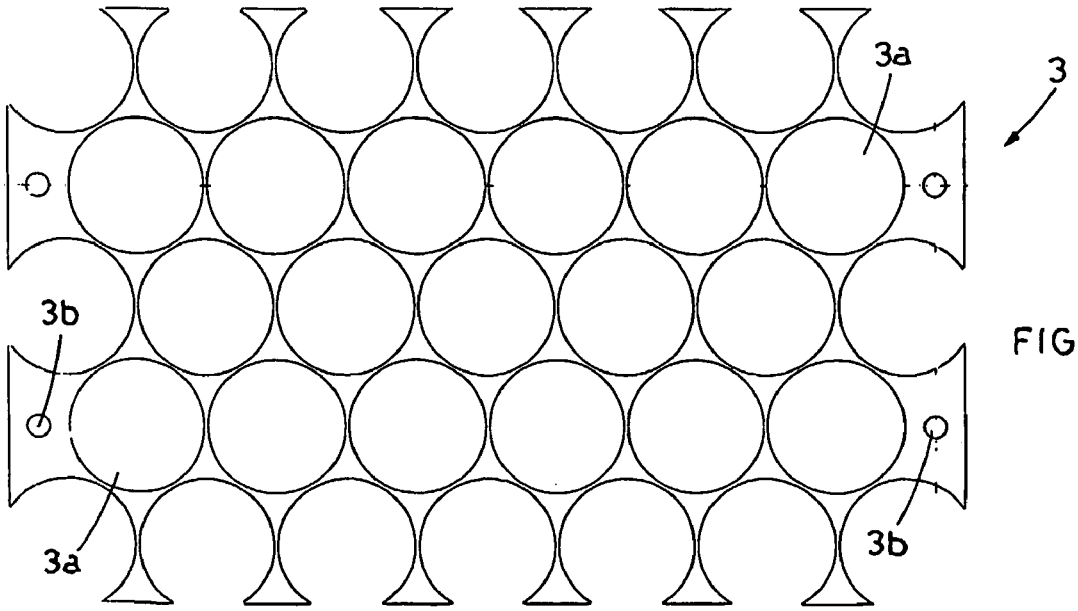
FIG. 2 is a view of the support spacing plate of the group of tubes.

FIG. 9 has been enclosed with the only purpose to show the possibility of realising the tank of the invention with any shape, including an irregular shape, according to the space where the tank is installed.

This characteristic of the tank of the invention is extremely helpful and useful in case of natural gas tanks installed in vehicle trunks. The cylinders that are currently used for this application have low capacity since they cannot use the available space at best, being impossible to realise cylinders with suitable shape and dimensions according to the space in the trunk where the tank is usually installed.

The invention claimed is:

1. A multi-cell tank for pressurised gas, characterised by the fact it comprises:

a group of tubes (2) supported by spacing plates (3) with a parallel close series of holes (3*a*) suitable for housing similar tubes (2*a*) that are placed in such a way that each tube (2*a*) is almost in contact with the adjacent tubes;

a body of fibrous resin (4) that fills all the spaces in the group of tubes, including perimeter spaces, where the resin is perfectly flush with the borders of the spacing plates (3);

two bottom covers (5) that close the two ends of the group of tubes (2) and feature a series of hemispherical domes (5*a*) on the internal side, which communicate through ducts (5*b*) and exactly match the opening of the tubes (2*a*) in the group (2);

tie rods (6) that join the two covers (5) to the group of tubes (2) and pass through the spaces in the group of tubes and through holes (3*b*) suitably provided on the spacing plates (3);

an external reinforced layer realised by wrapping it in a resin texture with continuos wire (7), on which a second texture (7*a*) with longitudinal direction only is laid in order to join the bottom covers (5) applied and tightened with tie rods (6) to the group of tubes (2);

a pre-formed external protection enclosure (8), preferably with aluminium sheet;

an ordinary gas valve applied on a hole located on one of the two bottom covers (5).

* * * * *